United States Patent [19]

Durbin

[11] 4,196,901

[45] Apr. 8, 1980

[54] TENNIS RACQUET

[76] Inventor: Enoch J. Durbin, 246 Western Way, Princeton, N.J. 08540

[21] Appl. No.: 774,677

[22] Filed: Mar. 7, 1977

[51] Int. Cl.[2] ..... A63B 49/02

[52] U.S. Cl. ..... 273/73 G

[58] Field of Search ..... 273/73 R, 73 C, 73 D, 273/73 E, 73 G, 73 H, 73 J

[56] References Cited

U.S. PATENT DOCUMENTS

| | | | |
|---|---|---|---|
| 1,539,019 | 5/1925 | Nikonow | 273/73 R |
| 1,862,581 | 6/1932 | Robinson | 273/73 E X |
| 1,930,285 | 10/1933 | Robinson | 273/73 D X |
| 2,132,780 | 10/1938 | Davis | 273/73 J X |
| 2,164,631 | 7/1939 | Abell | 273/73 H |
| 2,206,548 | 7/1940 | Goerke | 273/73 E |
| 2,311,172 | 2/1943 | Hetzel | 273/73 E |
| 3,702,701 | 11/1972 | Vaughn et al. | 273/73 C X |
| 3,801,099 | 4/1974 | Lair | 273/73 C |
| 3,913,911 | 10/1975 | Peterson | 273/73 C |
| 3,999,756 | 12/1976 | Head | 273/73 C |

FOREIGN PATENT DOCUMENTS

| | | | |
|---|---|---|---|
| 238250 | 4/1962 | Australia | 273/73 H |
| 1495578 | 8/1967 | France | 273/73 C |
| 14798 | of 1904 | United Kingdom | 273/73 H |
| 267837 | 3/1927 | United Kingdom | 273/73 D |
| 284754 | 2/1928 | United Kingdom | 273/73 H |

*Primary Examiner*—Richard J. Apley

*Attorney, Agent, or Firm*—Howard E. Thompson, Jr.

[57] ABSTRACT

A tennis racquet comprising a frame providing an open, tensioned string receiving, playing head of generally elliptical contour, and an elongated handle extending from one end of the head and terminating in a hand grip, the contour of the open head at the hand grip end thereof being closed at a point between the center of gravity and the hand grip end of said racquet. A preferred form of the racquet comprises a unitary frame bowed in its central portion to form a generally elliptical head contour and continuing as coplanar throat and shaft extensions which are joined at their extremeties in a hand grip, and the first joining of the ends being at a point between the center of gravity and the hand grip end of the racquet. Central longitudinal strings may join the frame at points closer to the hand grip end than is the center of gravity, and the longitudinal strings are under somewhat greater tension than the transverse strings. The racquet is characterized by reduced weight in the throat portion, resulting in the percussion center of the stringed area being significantly advanced toward the tip end of the racquet, and the vibration level being reduced.

13 Claims, 10 Drawing Figures

Fig. 1.
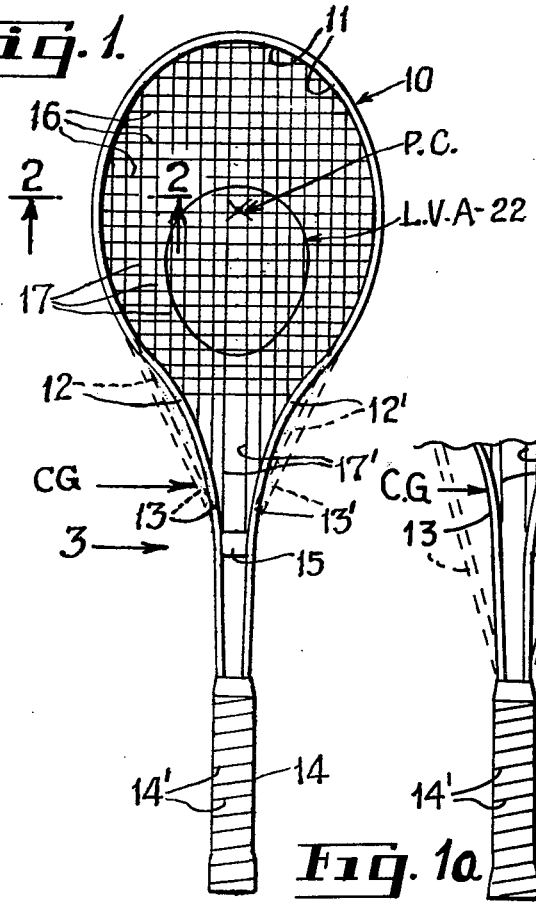
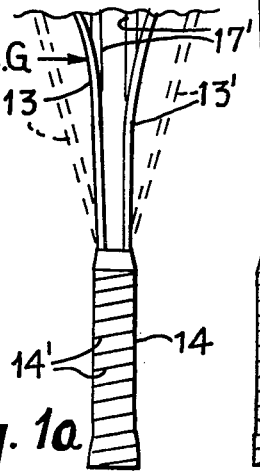
Fig. 1a
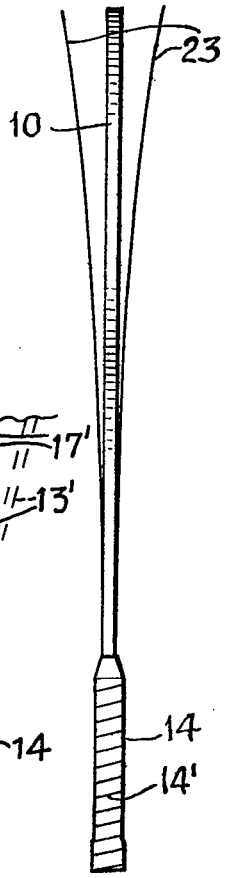
Fig. 4.
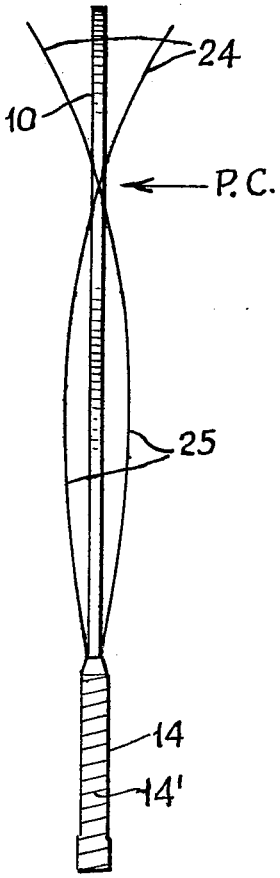
Fig. 5.
Fig. 2.
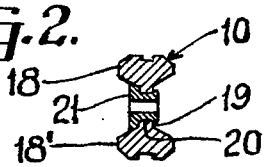
Fig. 3.
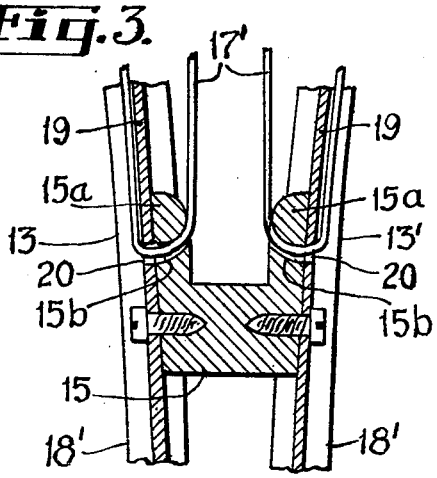
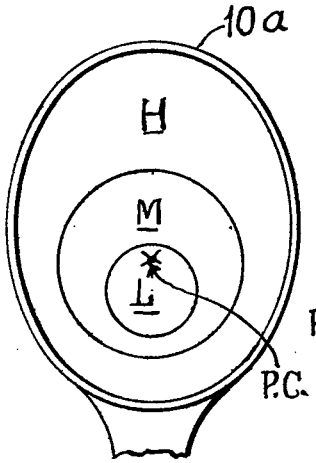
Fig. 6.
PRIOR ART
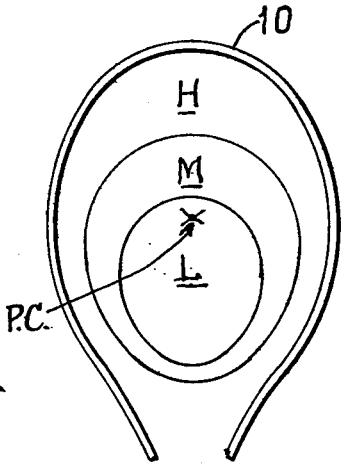
Fig. 7.

TENNIS RACQUET

This invention relates to a tennis racquet comprising a frame providing an open, tensioned string receiving, playing head of generally elliptical contour, and an elongated handle extending from one end of the head and terminating in a hand grip, the contour of the open head at the hand grip end thereof being closed at a point between the center of gravity and the hand grip end of said racquet. A preferred form of the racquet comprises a unitary frame bowed in its central portion to form a generally elliptical head contour and continuing as coplanar throat and shaft extensions which are joined at their extremeties in a hand grip, and the first joining of the ends being at a point between the center of gravity and the hand grip end of the racquet. Central longitudinal strings may join the frame at points closer to the hand grip end than is the center of gravity, and the longitudinal strings are under somewhat greater tension than the transverse strings. The racquet is characterized by reduced weight in the throat portion, resulting in the percussion center of the stringed area being significantly advanced toward the tip end of the racquet, and the vibration level being reduced.

BACKGROUND OF THE INVENTION

It has been the practice over the years in tennis racquet construction to provide a generally elliptical or circular closed frame to which interlaced transverse and longitudinal strings are attached under substantial tension to provide a yieldable playing head. With older type wood-frame racquets the handle, extending from the playing head and terminating in a hand grip was generally of solid construction, including a flared web or throat portion adjacent the playing head. When metal frames of tubular, I-beam, or other appropriate cross sectional contour have been employed, it has been customary to rigidly join the metal frame at the handle end of the playing head to complete the elliptical contour of the playing head and provide mounting means for the central longitudinal strings.

Tennis racquets of these varied constructions have characteristically had a so-called "sweet spot" in the playing head which is relatively small in comparison to the area of the playing head, and which is located considerably off center, longitudinally, in the direction of the handle of the racquet. The size and location of the "sweet spot" is of primary importance as this is the area in which a ball can be hit with maximum power and control. For it to be off-center toward the handle is doubly disadvantageous.

First the tendency is for a player to contact the ball, if possible, with the center of the playing head, and only the experts have the degree of control which enable that contact to be made closer to the handle.

Secondly, the conventional racquet does not provide the range which structural appearance would suggest in effectively playing hard to reach balls because the outer six inches or so of the playing head in the direction of the tip end of the racquet becomes progressively more "dead", and incapable of imparting speed and control of a ball being returned.

A recent innovation known as the "Prince" racquet has significantly enlarged the "sweet spot" by enlarging the area of the playing head, both in length and width while maintaining standard overall length (normally about 27 inches) in the racquet. This means that the playing head has been extended toward the handle, and much of the increase in area of the "sweet spot" is in the direction of the handle. The net effect is to provide a racquet which may improve the handling and control of close, easy to reach balls, but still does not enable the player to effectively handle and control the hard to reach balls.

THE INVENTION

It has now been discovered, in accordance with the present invention, that the "sweet spot", or what I will hereinafter refer to as the L.V.A. (low vibration area) can be significantly enlarged and extended toward the racquet tip by providing a tennis racquet frame having an open, tensioned string receiving, playing head of generally elliptical contour, and an elongated handle extending from one end of the head and terminating in a hand grip, in which the open head, at the hand grip end thereof, is closed at a point between the center of gravity and the hand grip end of said racquet.

The shape or peripheral contour of the generally elliptical head can be varied considerably while thus locating the closing or joining at the handle end at a point between the center of gravity and the hand grip end of the racquet. A preferred adaptation of the invention involves what might be termed an "open throated" racquet structure, in which a unitary frame part of compound curvature is bowed in its central portion to form a generally elliptical head and continues as coplanar throat and shaft extensions which are joined at their extremeties in a hand grip, and in which the first rigid joining of the frame is located at a point closer to the hand grip end of the racquet than is the center of gravity. This provides a stringed area which, as viewed with the racquet tip down, has what might be called a "hanging drop" periphery, with central longitudinal strings extending into the throat portion, and the centermost strings being secured to the frame at a point beyond, i.e. closer to the hand grip than, the center of gravity of the racquet.

To compensate for the absence of transverse bracing in the throat portion of the racquet the longitudinal strings are tensioned somewhat higher than the transverse strings, i.e. suitably about 10 to 25% higher tension in the longitudinal strings. This tends to spread and stiffen the frame at the throat portion, and the effect is enhanced by providing a divergence in the shaft portions betweeen the hand grip and the elliptical head. This divergence can range from about 5° when the frame has a reversed curve throat forming portion, to about 30° when essentially straight throat and shaft portions tangentially join the elliptical head portion.

With the new, open throated construction several of the center longitudinal strings will be longer than in a conventional racquet (having a fully elliptical playing head), and the center pair of strings may be as much as about four inches longer. This is believed to contribute to the unique "lively action" that players experience using the new racquet.

A standard, lightweight metal frame racquet of the popular 27-inch length may weigh approximately 13 ounces. Using the same type of basic materials a comparable racquet embodying the new structure will weigh approximately 12 ounces. For many tennis players this one ounce weight reduction will be attractive especially in their net play. Other players, however, may be willing to sacrifice this weight reduction for further enhancement of the size and location of the L.V.A (low vibration area), and this can be accomplished by judicious addition of weighting means to the racquet as will be more fully hereinafter described.

The invention will be more fully understood from a consideration of the following description and discussion, having reference to the accompanying drawing in which preferred adaptations of the invention and related diagrams are identified by suitable reference characters in each of the views, and in which:

FIG. 1 is a plan view of a tennis racquet in accordance with the present invention.

FIG. 1*a* is a fragmentary view of a racquet similar to FIG. 1 but showing a modified hand grip structure.

FIG. 2 is a fragmentary sectional view substantially on the line 2—2 of FIG. 1.

FIG. 3 is a fragmentary enlarged section of the portion of the racquet indicated by the arrow 3 in FIG. 1 and showing a modification.

FIG. 4 is a side view of the racquet shown in FIG. 1 having associated therewith a diagramatic illustration the first bending mode of the racquet.

FIG. 5 is a view similar to FIG. 4 having associated therewith a diagramatic illustration of the second bending mode of the racquet.

FIG. 6 is a diagramatic illustration of the low, medium and high vibration zones of a conventional racquet.

FIG. 7 is a view similar to FIG. 6 as applied to the racquet of FIGS. 1 to 5.

Figure 8:
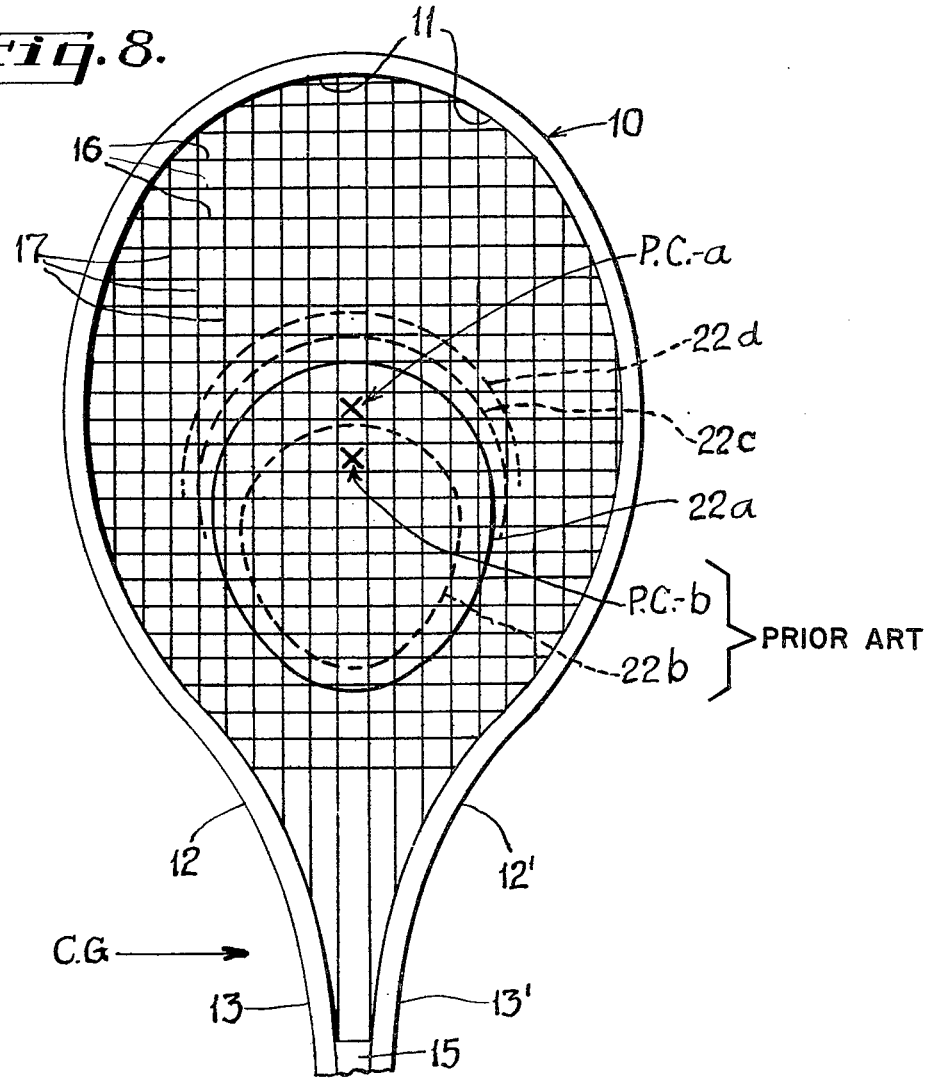
FIG. 8 is an enlarged view of the head portion of the racquet shown in FIG. 1 indicating a plurality of superimposed "minimum vibration zones"

As shown in FIG. 1 of the drawing the improved racquet comprises a frame 10 bowed to form a generally elliptical playing head portion 11 joined to elongated extensions including throat portions 12, 12' and shaft portions 13, 13' which are rigidly joined at their extremeties by hand grip 14. In the full line showing the throat portions 12, 12' having a reverse curvature and the shaft portions 13, 13', between the hand grip 14 and the throat portions have a slight divergence, suitably of the order of 5°. The contour of the throat portions 12, 12' can be considerably varied, however, to the extreme condition shown in dotted lines in which the throat and shaft portions 12, 13 and 12', 13' are essentially straight or colinear, and in tangentially joining the head portion 11, may have a divergence of as much as about 30°.

The shaft portion 13, 13' are rigidly joined together by a lightweight, metal or plastic spacer 15 which is located between hand grip 14 and the center of gravity C.G. of the racquet. The hand grip 14 is of conventional construction and has an outer wrap 14' of cushioning and slip resistant material.

The playing head portion 11 has a plurality of transverse tensioned strings 16 interlaced with a plurality of longitudinal tensioned strings 17, and it will be noted that several of the central strings 17 extend into the throat portion of the racquet, with the center pair of strings 17' being secured to the shaft portions 13, 13' of the frame at points close to the spacer 15.

The frame 10 can be fashioned from a variety of materials including wood, laminated wood; plain or reinforced plastics, and metals of tubular and other cross sectional configurations. For purpose of illustration the frame 10 in FIGS. 2 and 3 has been shown as having an I-beam cross section with parallel cross members 18, 18' in the plane of the racquet joined by connecting web 19 perpendicular to said plane. The web 19 is provided with appropriately spaced apertures 20 for lacing of the strings 16, 17, and to minimize abrasion of the strings passing through said apertures the apertures 20 are preferably lined with cushioning members of bushings 21, suitably formed of plastic material.

Depending on the divergence of the shaft portions 13, 13' the spacing of web portions 19 of the frame at the point of anchoring central longitudinal strings 17' may be greater than the desired spacing of strings 17, causing a slight divergence of the center strings 17' as they approach the point of anchorage. While this does not adversely affect the playing characteristics of the racquet the spacing of the center strings 17' can, if desired, be controlled by providing extensions **15*a* on spacer 15 having string receiving passages 15*b* which align with apertures 20 in the frame web 19. In instances when strings adjacent the center strings 17' would also be divergent if directly anchored to the frame, the extensions 15*a* can protrude along webs 19 to provide guide passages similar to passages 15*b*** at the points of mounting of such strings. It should be noted, however, that any addition of weight in this portion of the racquet should be held to the minimum.

The illustration in FIG. 1 is scaled to a standard 27-inch racquet, but it should be borne in mind that the structural features can apply to racquets of any size, including substantially shorter "youth" racquets. In some instances, particularly with shorter racquets, the spacer 15 may be omitted as shown in FIG. **1*a*, in which event the hand grip 14** becomes the first rigid joining of the frame. In such a construction the racquet frame will comprise simply the generally elliptical head and handle, and the handle can be a single shaft joined to a closed loop head, provided the closure at the handle end of the head is located between the center of gravity and the hand grip end of the racquet.

The absence of transverse bracing between throat portions 12, 12' of the frame might seem to indicate a transverse weakness in this portion of the racquet, but any tendency toward this is offset by providing greater tension in longitudinal strings 17 than in transverse strings 16. The longitudinal tension should be at least 5% higher and suitably about 10 to 25% higher, depending in part on the degree of divergence in the throat and shaft portions 12, 13 and 12', 13' of the frame. This added tension in the longitudinal strings imparts a spreading force to the frame which appears to effectively substitute for a rigid connection in the throat portion; and the ability to eliminate substantial weight in the throat portion is a key to the remarkably improved performance of racquets in accordance with the present invention.

The improvement in tennis racquet performance which significantly enlarges and extends toward the racquet tip the L.V.A. (low vibration area) is attributed to the fact that the above-mentioned reduction in weight or mass of the racquet has been accomplished in the throat portion of the racquet.

The weight or mass of the throat portion is totally attributable to the weight or mass of the unitary hand grip structure, the spaced rails, and the joining means, if present, in the throat portion.

Spaced rails have a lower weight for the same strength as compared with a unitary structure; hence the unitary hand grip structure should not extend into the central or throat portion of the racquet. The unitary hand grip structure should therefor be less than 40%, and preferably less than 30%, of the overall racquet length. As shown in FIG. 1 of the drawing, which is scaled to a standard 27-inch racquet, the hand grip 14 is approximately 25% of the overall racquet length.

The reduction of the weight or mass of the joining means is illustrated in FIG. 1. The joining means or spacer 15 weighs only about 0.2 ounce, and even with the extensions 15*a* shown in FIG. 3 the spacer weighs less than 0.5 ounce. In some adaptations of the invention, as when the frame is contoured as shown in dotted lines in FIG. 1, the extensions 15*a* could be substantially longer, providing guides for additional longitudinal strings 17'; but even as thus enlarged the weight of the spacer 15 should be held to less than one ounce.

It is considered that such elimination of mass in the throat portion can best be achieved, in a racquet having a generally elliptical playing head and an elongated handle extending from one end of said head and terminating in a unitary hand grip structure, by employing as an essential combination of structural features:

a. an elongated handle comprising two spaced rails joined to said unitary hand grip structure, and b. a hand grip structure having a length which is less than 40% of the overall length of the racquet together with at least one of the structural features that comprise:

c. closing the racquet frame at the hand grip end of the playing head by joining means which weighs less than one ounce, and d. fashioning the playing head to provide an asymmetric extension in the direction of the hand grip end of the racquet so that closing of the playing head is located at a point between the center of gravity and the hand grip end of the racquet.

In FIG. 1 of the drawing the percussion center P.C. of the racquet has been shown as being in substantial alignment with the widest part of the head portion 11, with the low vibration area 22 extending a short distance toward the tip end of the racquet and a substantial distance toward the hand grip end. The significance of the size and location of L.V.A 22 will be more fully understood from consideration of the following discussion.

FIGS. 4 and 5 which show an edge view of the racquet frame 10 and hand grip 14 as shown in FIG. 1 diagramatically illustrates respectively the first bending mode and second bending mode of the racquet frame. The scale of bending is much exaggerated for the sake of clarity, and it will be seen that the first bending mode is much like that of a diving board, with movement increasing regularly from the hand grip 14 to a maximum vibration 23 at the racquet tip. This is a relatively slow vibration of about 16 CPS and is induced in the frame when force is applied at the racquet head, and induces no vibration in the hand grip 14, because the period of vibration is long compared to the duration of ball contact.

When force is applied to the racquet at points above or below percussion center P.C. this induces the second bending mode as shown in FIG. 5 in which the frame bends with respect to fixed points defined by the hand grip and percussion center P.C which is at approximately the node of this bending mode. The vibration at the tip as at 24, and between the hand grip and P.C. as at 25 is very rapid, i.e. of the order of 100 vibrations per second, and it is this bending mode which causes vibrations in the hand grip 14. Force applied at points above P.C. generates the first and second bending moments, in phase with each other causing an additive effect and a more rapid increase in the amount of vibration with increase of distance of the point of impact above P.C. than with increase of distance of the point of impact below P.C.

In contrast to this a ball hitting the racquet below P.C. induces the second bending mode out of phase with the first with the result that there is a partial cancellation and less vibration is produced. This cancellation affects the size of the initial impulse.

In addition analysis of the bending modes of a simple beam show the basic asymetry in bending amplitude described previously, wherein the bending amplitude a given distance above the P.C. can be much larger than the bending amplitude the same distance below the P.C. This accounts for the fact that the low vibration area L.V.A as shown in FIG. 1 and L. as shown in FIGS. 6 and 7 extends a substantial distance below P.C. and only a short distance above P.C.

In considering FIGS. 6 and 7 it must be realized that the low, medium and high vibration zones L, M, and H are not sharply defined, so the showing is diagramatic. Low vibration in zone L is barely perceptible in the hand grip, medium vibration in zone M is perceptible but not very objectionable and high vibration in zone H is most objectionable for three reasons.

Firstly, in zone H much of the energy to be imparted to the ball is dissipated in racquet vibrations, hence the ball velocity when leaving the face of the racquet is considerably lower than when the ball leaves the L.V.A for the same overall angular velocity of the racquet, causing the ball to fall short of the player's intended range.

Secondly, the vibration frequency is high enough to cause multiple ball contact during a single stroke, hence the exact angular position of the face of the racquet is arbitrary at the moment the ball leaves the racquet. This causes the ball to take an angular direction which, most of the time, will be different than the player's intended direction.

Thirdly, the vibration force is transmitted through the frame of the racquet to the handle of the racquet and then to the arm of the player. This high vibration appears to be conductive to tendonitis and bursitis and other irritations commonly called "tennis elbow".

In FIG. 6 there has been shown the head of a conventional racquet having a frame in the form of a closed elipse 10*a*. With this construction P.C. is not aligned with the widest part of frame 10*a*, but is substantially closer to the handle end of the frame, and zone L is quite small. A ball struck in the center of the racquet head will be in zone M, and a substantial portion of the area of the playing head is in high vibration zone H.

In FIG. 7, which corresponds with FIG. 1 and has open throated frame 10, note that P.C. is aligned substantially with the widest portion of the frame and zone L is substantially larger than in FIG. 6. This raises and enlarges zone M and in effect pushes most of zone H off the end of the racquet.

A comparison of FIGS. 6 and 7 shows very clearly why the improved racquet construction of the present invention not only enhances the useful area efficiency and precision of control of the playing head, but also enhances the comfort of the player by greatly reducing the amount of objectionable vibration which will be transmitted to the hand grip and thence to the player's arm.

For the player who is interested in extending his effectiveness in returning the head to reach balls, and is less interested in the advantages of light weight for quickness in net play, it is possible by judicious application of small amounts of weight to the racquet to move P.C. beyond the widest portion of the frame, and in so doing to further enlarge and extend zones L and M.

As a guide to such further refinement reference should be made to the formula:

$$R=(J)/(M\times r)$$

where

"R" is the distance from the base (hand grip end) of the racquet to P.C. in inches.

"J" is the moment of inertia of the racquet in ounces-×inches$^2$.

"M" is the mass of the racquet in ounces, and

"r" is the distance from the base of the racquet to the center of gravity C.G. in inches.

By way of illustration a 27-inch racquet as shown in FIG. 1 having a moment of inertia "J" of 3354 oz.×in.$^2$, a mass "M" of 12 ounces and a distance "r" of 13 inches calculates to a distance "R" of 21.5 inches; and this is the approximate location of P.C. on the racquet.

In order to increase "R" any additions of weight must have the effect of increasing the numerator in the formula by an amount proportionately greater than the increase in the denomenator. Some factors to consider are:

1. Weight added to the racquet tip has the advantage of racquet length squared in increasing "J", but both "M" and "r" are also increased.

2. Addition of a balancing weight at the base of the racquet will increase "M" and reduce the increase in "r" without changing "J", but the net effect may be beneficial.

3. Weight applied to the racquet tip lowers second mode vibration frequency while similar weights applied at the sides of the racquet head in alignment with P.C. are less effective in lowering the vibration frequency, although the latter weight placement tends to increase the moment of inertia against twisting of the racquet when a ball hits to the left or right of center.

Figure 9:
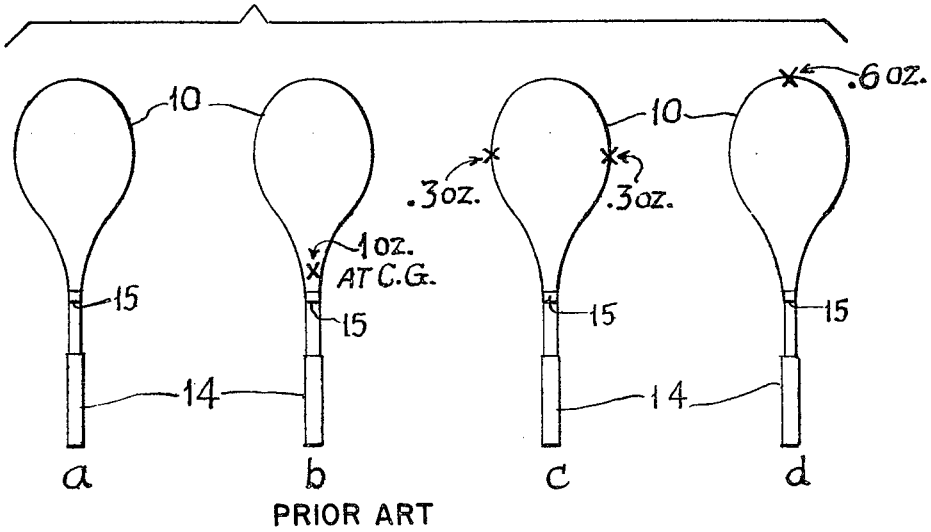
FIG. 9 is a composite view diagramatically indicating various weight placements associated with the drawing in FIG. 1.

To better illustrate the effect of weight additions at different locations, attention is directed to FIGS. 8 and 9. FIG. 8 shows on an enlarged scale the playing head portion 11 of the racquet shown in FIG. 1 with parts identified by similar reference characters, and *22a* representing the minimum vibration area M.V.A around percussion center P.C. of the racquet without modification. FIG. 9 diagramatically illustrates at a the unmodified racquet, and at b, and c, and d modifications with weights added at the location and in the amounts indicated; and the approximate minimum vibration areas are superimposed on FIG. 8 as *22b, 22c, 22d.*

In FIG. *9b,* which shows addition of one ounce of weight at the center of gravity C.G., the modified condition approximates that in a conventional racquet of the same size, because the new construction has reduced the net mass in the general area of C.G. by approximately one ounce. A comparison of *22a* and *22b* and the locations of P.C.-a and P.C.-b in FIG. 8 clearly shows the advantage of the new construction.

The amounts of weight added in FIG. *9c* and *9d* are probably greater than would normally be used (except by a player comfortable with a heavier racquet), but they are of a magnitude to permit clear visualization of the relative effects of different weight placements.

As earilier mentioned the arrangement shown in FIG. *9c* has the advantage of increasing the twisting moment of inertia, while somewhat extending the M.V.A.

While weight additions and adjustments will generally be made by the individual in perfecting the "feel" he likes in a racquet, it is contemplated some arrangements of supplemental weights may be of sufficiently general interest to be included as "original equipment" on certain styles or models of the new racquet. It is to be understood, however, that the further advantage of M.V.A. enlargement by weight addition(s) is in the nature of a "fringe benefit", and that the big advantage in enlargement, and extension toward the racquet tip of the M.V.A. is achieved by the structure of the new racquet, wherein the head closure at its handle end, or the first rigid joining of the frame is located between the center of gravity and the hand grip end of the racquet.

Various changes and modifications in the improved tennis racquet as herein disclosed may occur to those skilled in the art, and to the extent that such changes and modifications are embraced by the appended claims, it is to be understood that they constitute part of the present invention.

I claim:

1. A tennis racquet comprising a frame bowed to form a generally elliptical playing head portion joined to elongated extensions including throat portions and shaft portions, said shaft and throat portions being spaced apart and joined only at the extremeties of said shaft portions by a hand grip having a length which is less than 40% of the overall racquet length, and interlaced transverse and longitudinal strings providing a resilient impact member throughout said head portion and the space between said throat and shaft portions of said frame, said tennis racquet being characterized in that the percussion center of said racquet is uniquely advanced toward the tip end of the racquet and the vibration level is reduced by reason of the reduced mass in the throat portion of said racquet.

2. A tennis racquet as defined in claim 1, wherein the tension in said longitudinal strings is greater than the tension in said transverse strings to thereby enhance the transverse stiffness in the throat portion of said racquet.

3. A tennis racquet as defined in claim 2, wherein the tension in said longitudinal strings is about 5% to 25% greater than the tension in said transverse strings.

4. A tennis racquet as defined in claim 1, wherein said shaft and throat portions of said frame have reverse curved contours in joining said generally elliptical portion.

5. A tennis racquet as defined in claim 1, wherein said shaft and throat portions of said frame are essentially colinear and tangentially join said generally elliptical portion.

6. A tennis racquet comprising a frame bowed to form a generally elliptical playing head portion joined to elongated extensions including throat portions and shaft portions, said shaft and throat portions being spaced apart and joined at the extremeties of said shaft portions in a hand grip having a length which is less than 40% of the overall racquet length, spacer means secured between said elongated extensions in spaced relation to said hand grip, said spacer means weighing less than one ounce and completing a playing head portion of said racquet, and interlaced transverse and longitudinal strings providing a resilient impact member throughout said playing head portion of the racquet, said tennis racquet being characterized in that the percussion center of said racquet is uniquely advanced toward the tip end of the racquet and the vibration level is reduced by reason of the reduced mass in the throat portion of said racquet.

7. A tennis racquet as defined in claim 6, wherein the location of said spacer means is such as to provide a playing head which is assymetrically extended in the direction of said hand grip.

8. A tennis racquet as defined in claim 7, wherein the tension in said longitudinal strings is greater than the tension in said transverse strings to thereby enhance the transverse stiffness in the throat portion of said racquet.

9. A tennis racquet as defined in claim 8, wherein the tension in said longitudinal strings is about 5% to 25% greater than the tension in said transverse strings.

10. A tennis racquet as defined in claim 6, wherein said spacer means is located between the center of gravity of the racquet and said hand grip.

11. A tennis racquet as defined in claim 6, wherein portions of said extensions between said spacer means and generally elliptical portion are of reverse curved contour.

12. A tennis racquet as defined in claim 6, wherein portions of said extensions between said spacer means and generally elliptical portion are essentially straight and tangentially join said elliptical portion.

13. A tennis racquet as defined in claim 6, wherein said spacer means includes spaced portions extending along said extensions in the direction of the racquet head, said spaced portions having means for guiding and spacing the central longitudinal strings at the points of attachment to said frame.

* * * * *

US004196901B1

REEXAMINATION CERTIFICATE (3516th)

United States Patent [19] [11] B1 4,196,901

Durbin [45] Certificate Issued May 26, 1998

[54] TENNIS RACQUET

[76] Inventor: Enoch J. Durbin, 246 Western Way, Princeton, N.J. 08540

Reexamination Request:
No. 90/004,036, Nov. 22, 1995

Reexamination Certificate for:

| | |
|---|---|
| Patent No.: | **4,196,901** |
| Issued: | **Apr. 8, 1980** |
| Appl. No.: | **774,677** |
| Filed: | **Mar. 7, 1977** |

[51] Int. Cl.[6] ..... A63B 49/02
[52] U.S. Cl. ..... 473/537
[58] Field of Search ..... 273/73 R, 73 C, 273/73 G, 73 H

[56] References Cited

U.S. PATENT DOCUMENTS

| | | | |
|---|---|---|---|
| Re. 31,419 | 10/1983 | Frolow | 273/73 C |
| 3,086,777 | 4/1963 | Lacoste | 273/73 C |
| 3,999,756 | 12/1976 | Head | 273/73 C |
| 4,165,071 | 8/1979 | Frolow | 273/73 C |

*Primary Examiner*—William Stoll

[57] ABSTRACT

A tennis racquet comprising a frame providing an open, tensioned string receiving, playing head of generally elliptical contour, and an elongated handle extending from one end of the head and terminating in a hand grip, the contour of the open head at the hand grip end thereof being closed at a point between the center of gravity and the hand grip end of said racquet. A preferred form of the racquet comprises a unitary frame bowed in its central portion to form a generally elliptical head contour and continuing as coplanar throat and shaft extensions which are joined at their extremeties in a hand grip, and the first joining of the ends being at a point between the center of gravity and the hand grip end of the racquet. Central longitudinal strings may join the frame at points closer to the hand grip end than is the center of gravity, and the longitudinal strings are under somewhat greater tension than the transverse strings. The racquet is characterized by reduced weight in the throat portion, resulting in the percussion center of the stringed area being significantly advanced toward the tip end of the racquet, and the vibration level being reduced.

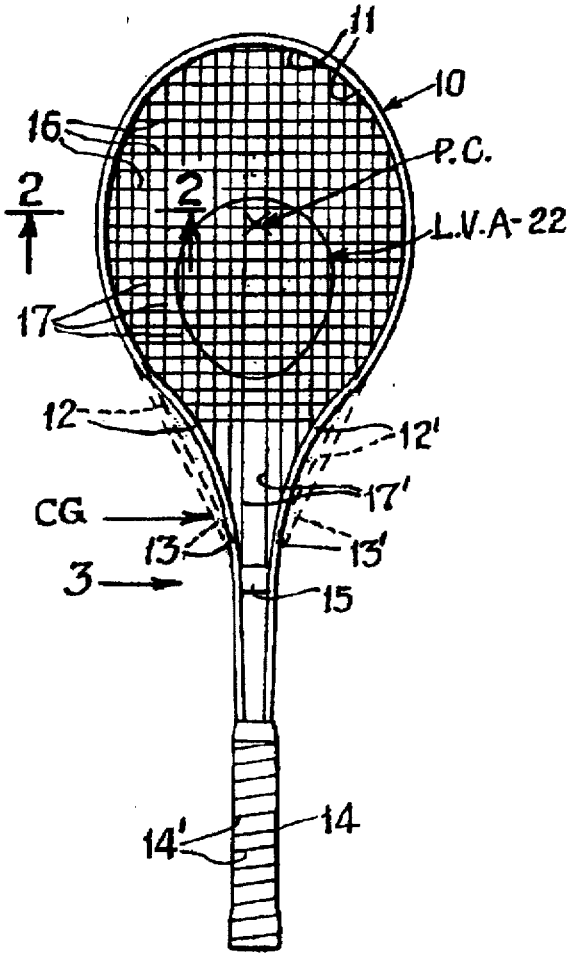

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *